United States Patent [19]

Wixon

[11] 4,013,577

[45] Mar. 22, 1977

[54] HEAVY DUTY DRY BIODEGRADABLE DETERGENT COMPOSITION

[75] Inventor: Harold Eugene Wixon, New Brunswick, N.J.

[73] Assignee: Colgate-Palmolive Company, New York, N.Y.

[22] Filed: Apr. 14, 1972

[21] Appl. No.: 244,259

[52] U.S. Cl. ..... 252/109; 252/121; 252/532; 252/534; 252/551; 252/553

[51] Int. Cl.[2] ..... C11D 1/24; C11D 3/08; C11D 3/10

[58] Field of Search ..... 252/89, 99, 109, 110, 252/132, 532, 551

[56] References Cited

UNITED STATES PATENTS

| | | | |
|---|---|---|---|
| 2,264,103 | 11/1941 | Tucker | 210/23 |
| 2,941,950 | 6/1960 | Korpi | 252/551 |
| 3,332,876 | 7/1967 | Walker | 252/551 |
| 3,523,902 | 8/1970 | Schmolka | 252/551 |
| 3,590,001 | 6/1971 | Taylor | 252/135 X |
| 3,600,318 | 8/1971 | Mast | 252/99 |
| 3,629,121 | 12/1971 | Eldib | 252/89 |
| 3,676,338 | 7/1972 | Fries et al. | 252/109 X |
| 3,700,599 | 10/1972 | Mizuno | 252/99 |
| 3,707,503 | 12/1972 | Kenny | 252/117 |
| 3,725,290 | 4/1973 | Nelson | 252/110 |
| 3,740,339 | 6/1973 | MacDonald | 252/135 |
| 3,741,911 | 6/1973 | Shane | 252/527 |
| 3,743,610 | 7/1973 | Weldes | 252/527 |
| 3,748,093 | 7/1973 | Gangwisch et al. | 8/137 |
| 3,749,676 | 7/1973 | Crutchfield | 252/135 |
| 3,755,201 | 8/1973 | Trimmer et al. | 252/526 |
| 3,755,203 | 8/1973 | Bentley et al. | 252/536 |
| 3,758,419 | 9/1973 | Hayden et al. | 252/551 |
| 3,844,982 | 10/1974 | Connor et al. | 252/544 |
| 3,849,327 | 11/1974 | DiSalvo et al. | 252/109 |
| 3,892,680 | 7/1975 | Benjamin et al. | 252/532 |
| 3,915,903 | 10/1975 | Wise | 252/552 |

FOREIGN PATENTS OR APPLICATIONS

| | | | |
|---|---|---|---|
| 36,588 | 11/1970 | Japan | |
| 1,189,114 | 4/1970 | United Kingdom | 252/121 |

OTHER PUBLICATIONS

"Studies on Replacement of Phosphate Builders in Laundry Detergents Using Radiolabeled Soils" by J. C. Illman et al., J.O.A.C.S., vol. 49, Apr., 1972, pp. 217–221.

"Reduction of Phosphate Builder in Tallow–Based Detergent Formulations" by R. G. Bistline et al., *J. Am. Oil Chemists Soc.*, vol. 48, Feb., 1971, pp. 74–76.

Stensby, Part IV, Soap & Chemical Specialties, Sept. 1967, pp. 96, 98, 100, 132, 135, 137, 138.

*Primary Examiner*—P.E. Willis, Jr.
*Attorney, Agent, or Firm*—Norman Blumenkopf; Herbert S. Sylvester; Murray M. Grill

[57] ABSTRACT

A biodegradable heavy duty dry detergent composition including a higher fatty alkyl polyethoxy sulfate and a nonphosphate builder, the composition exhibiting outstanding hard water resistance. A preferred composition includes a compound of the formula $RO(C_2H_4O)_3SO_3Na$ wherein R is a mixed fatty alkyl of from 12–15 carbon atoms and a non-phosphate builder selected from carbonates, silicates, citrates, oxydiacetates, polycarboxylates, etc.

19 Claims, No Drawings

HEAVY DUTY DRY BIODEGRADABLE DETERGENT COMPOSITION

This application relates to a heavy duty dry detergent composition. More particularly, this invention relates to a biodegradable dry heavy duty detergent composition containing no phosphate builders, the composition having excellent hard water resistance.

Public awareness of the importance of improving the environment and avoiding disruptive effects on the ecology has been increasing greatly and as a result thereof wide-spread reexaminations of waste disposal methods have been undertaken. From various studies of our lakes, rivers, streams and ground waters, it has been concluded by some that ordinary household detergents, especially those comprising long-lasting synthetic organic detergents and phosphate builders, have had detrimental effects on such waters. The surface active organic compounds which are not readily decomposed after discharge from the sink, wash tube or washing machine, may find their way into natural streams, creeks, rivers and lakes.

The major manufacturers of detergents and other surface active materials are endeavoring to remove from their products long-lasting synthetic organic detergents such as the highly branched alkyl aryl sulfonates which are non-biodegradable and have replaced these with comparatively easily degradable straight chain alkyl benzene sulfonates or similar materials which will be destroyed in a short time.

Efforts have also been made to modify existing detergent composition formulas so as to produce a product with excellent cleaning properties while not containing any phosphate materials. This has been especially difficult to accomplish since effective building, peptizing, soil-suspending and cleaning actions of the polyphosphates, especially pentasodium tripolyphosphate and tetrasodium pyrophosphate and analogous polyphosphoric acid salts are not generally possessed by any non-phosphate builders. At this time, the general class of builders represented by nitrilotriacetic acid (NTA) produce detergent compositions on a par with the phosphate built detergent compositions, however, these NTA deergent compositions are also coming under attack since it appears that the NTA itself also produces detrimental effects on the environment. At the present time there is great activity in providing effective, safe and acceptable detergent compositions which do not contain phosphate or nitrogen compounds as builders and which are easily biodegradable so that no long-lasting detergents will be placed into the ecological cycle.

Within the above environment and background, the composition of the present application was developed. The heavy duty dry detergents of the present invention are based on a simple, inexpensive and commercially available anionic detergent, i.e. higher fatty alkyl polyethoxy sulfate, which is readily biodegradable. In addition, these compositions contain no significant content of polyphosphates or other phosphate builder salts or any significant nitrogen compounds as builders. In the composition of the present invention, the builder function is supplied by a series of non-phosphate builders such as sodium citrate or its equivalent, sodium carbonate or its equivalent, sodium silicate, oxydiacetates, polycarboxylates, etc. The composition of the present invention also may include various other fillers, foam suppressing agents, brightening agents, adjuvants, perfumes, colorants, etc.

It is therefore the primary object of the present invention to provide a novel heavy duty dry detergent composition which is biodegradable.

It is a further object of the present invention to provide a heavy duty dry detergent composition containing no significant phosphate concentrate and based on a biodegradable synthetic anionic detergent.

It is a still further object of the present invention to provide a non-phosphate built biodegradable detergent composition having outstanding hard water resistance.

It is a still further object of the present invention to provide a heavy duty dry detergent composition having hard water resistance based on a higher fatty acid alkyl polyethoxy sulfate anionic detergent.

Still further objects and advantages of the composition of the present invention will become more apparent from the following more detailed description thereof.

In the broadest sense, the heavy duty dry detergent of the present invention comprises from 8 to 30% by weight of a higher fatty alkyl polyethoxy sulfate of the formula $RO(C_2H_4O)_nSO_3M$, wherein R is a fatty alkyl of from 10 to 20 carbon atoms, $n$ is a number from 2 to 6, $n$ being from one-fifth to one-third of the number of carbon atoms in R, and M is a solubilizing, salt-forming cation such as an alkali metal, ammonium, lower alkylamino or lower alkanolamino; 30 to 70% by weight of a non-phosphate builder selected from sodium carbonate or its equivalents, sodium silicates, sodium citrates or their equivalents, oxydiacetates, polycarboxylates, etc.; about 0 to 5% by weight of a soap; and from about 10 to 50% by weight of a filler.

The sulfated, ethoxylated higher fatty alcohol detergent utilized in the present invention is of the formula $RO(C_2H_4O)_nSO_3M$, wherein R is a fatty alkyl of from 10 to 20 carbon atoms, $n$ is a number from 2 to 6, $n$ being from one-fifth to one-third of the number of carbon atoms in R, and M is a solubilizing, salt-forming cation such as sodium, potassium, ammonium, lower alkylamino, lower alkanolamino, etc. This anionic detergent is most readily biodegradable and has better detergency when the fatty alkyl group is terminally joined to the polyoxyethylene chain which, of necessity, is also terminally joined to the sulfur in the sulfate group. Although a slight amount of branching of the higher alkyl may be tolerated, to the extent of not more than 10% of the carbon atom content of the alkyl not being in a straight carbon chain, generally even this minor deviation from linear structure is to be avoided. Also, medial joinder of the alkyl to the ethoxy chain should be minimal, i.e. less than 10%, and even such joinder should preferably be concentrated near the end of the alkyl chain. Within the 10 to 20 carbon atom alkyl groups, the preferred alkyls are of 12 to 15 carbon atoms and those most preferred are the mixed alkyls containing 12, 13, 14, and 15 carbon atoms chains. The mixture is preferably one with at least 10% of each chain length and no more than 50% of any one chain length.

The ethylene oxide content of the anionic detergent is such that $n$ is from 2 to 6 and preferably from 2 to 4 and generally averaging about 3, especially when R is a mixed 12–15 carbon atom alkyl mixture. To maintain a desired hydrophiliclipophilic balance when the carbon content of the alkyl chain is in the lower portion of the 10–20 range, the ethylene oxide content might be reduced so that $n$ is about 2, whereas when R is in the range of from 16 to 18 carbon atoms, $n$ may be within the range of from 4 to 6.

The salt-forming cation may be any suitable solubilizing metal or radical but will most frequently be an alkali metal cation or an ammonium cation. If alkylamine or lower alkanolamine groups are present, alkyls and alkanols thereof usually contain 1 to 4 carbon atoms and the amines and alkanolamines may be mono-, di- or tri-substituted, i.e. monoethanolamine, diisopropanolamine, trimethylamine, etc.

The importance of using the correct anionic detergent in the present composition is shown by the failure of corresponding alcohol sulfates of similar dry and liquid detergent compositions to wash as well as the present compositions containing the higher alcohol ethylene oxide sulfates. For example, a higher alcohol sulfate in which the alcohol is a mixed 12–15 carbon atoms alcohol, exhibits a significantly poorer detergency than the compositions of the present invention. Even within the preferred range of alcohol polyethoxy sulfates, an improvement in detergency is noted for compositions which include a mixed 12–15 carbon atoms alcohol polyethoxy sulfate when compared to other higher alkyl ethoxy sulfates such as a mixed 14–15 carbon atoms polyethoxy sulfate of the same ethoxy chain length. The preferred detergent is available from Shell Chemical Company and identified by them as Neodol 25–3S, the sodium salt normally sold as a 60% active material including about 40% of the aqueous solvent medium, of which a minor proportion is ethanol. Although this material is the sodium salt, the potassium and other suitable soluble salts may be utilized either in partial or complete substitution for that of sodium.

Exaples of the higher alcohol polyethoxy sulfates which may be utilized as the major anionic detergent constituent of the present heavy duty dry detergent composition or as partial substitutes for the above-noted preferred anionic detergent include; mixed $C_{12-15}$ normal primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt and mixed $C_{10-18}$ normal primary alkyl triethenoxy sulfate, potassium salt. Minor proportions of the corresponding branched chain and medially alkoxylated detergents, such as those described above but modified to have ethoxylation at a medial carbon atom, e.g., one located four carbons from the end of the chain, may be employed but the carbon atom content of the higher alkyl will be the same. Similarly, the joinder of a normal alkyl may be at a secondary carbon one or two carbon atoms removed from the end of the chain. In either case, only the minor proportions previously mentioned will be present.

The composition of the present invention also includes at least one non-phosphate builder selected from the following: citrates, silicates, carbonates, oxydiacetates, polycarboxylates, and mixtures thereof. Generally, the citrates may be supplied as sodium citrate or any other water-soluble salt utilizing alkali metal cations, ammonium amine cations, alkanolamine and the like. Citric acid may also be utilized, particularly if the pH of the final composition is desired to be somewhat on the acid side. Furthermore, the citrate compounds may be utilized either in the form of hydrates or anhydrous form.

The water-soluble silicates which may be utilized as builders in the present dry composition are alkaline materials which also function as anti-corrosion or protective additives and are particularly helpful in removing particulate soil from the laundry and preventing harm to ceramic, porcelain, vitreous, aluminum and steel parts of washing machines, similar equipment and laundered items.

Although various soluble silicates may be utilized providing that their alkalinities are sufficient to aid in building and anti-corrosion functions, those which are most effective and readily available are the alkali metal silicates, especially those wherein the $Na_2O:SiO_2$ or $K_2O:SiO_2$ ratios are within the range of 1:1.5 to 1:2.5. Particularly useful are the alkali metal silicates, i.e. sodium silicates, wherein the ratios are 1:1.6 or 1:2.35. Of these latter two materials, the more alkaline 1:1.6 ratio silicate is preferred because of its greater alkalizing, neutralizing and solubilizing abilities. It will often be desirable to adjust the final $Na_2O:SiO_2$ ratio, for example, to about 1:2, and this is conveniently and effectively done by utilizing a mixture of silicates of higher and lower ratios. Such a mixture is generally formed by mixing approximately equal proportions by weight of silicates having ratios of 1:1.6 and 1:2.35. It will be apparent that the lower the ratio the higher the alkalinity of the silicate and, therefore, when it is desired to raise the alkalinity, the average $Na_2O:SiO_2$ ratio will be increased. Other silicates within the described broad range may be utilized either alone or in mixture depending on particular detergent compositions and the compatibility of the various other constituents. Although silicates having ratios outside the 1:1.5 to 1:2.5 range may be utilized, such as those of ratios of 1:1 and 1:3, generally the proportions of such silicates will be minor, being generally less than 10% of the total content. Both the sodium and potassium silicates are useful as building and alkalizing agents in the detergents of the present invention.

The carbonates utilized may be utilized either in their usual hydrated form or as soda ash and when lower pHs are desirable, the bicarbonates may be utilized. In addition to these materials, the oxydiacetate salts or diglycolates and the polycarboxylates may be utilized as builders in the composition of the present invention.

Generally, the composition of the present invention is produced by spray-drying an aqueous detergent and builder crutcher mix.

In addition to the nonionic higher fatty acid alkyl polyethoxy sulfate detergent and the builder composition, the composition of the present invention may contain significant amounts of fillers and a minor portion of anti-foam agents, coloring agents, perfumes, brighteners and supplemental detergents. These additional materials which will be described more fully below, may be either added to the crutcher mix if compatible therewith or sprayed onto the dried product while in a tumbling drum.

As noted above, the composition of the present invention may contain a significant amount of a filler material such as sodium chloride or sodium sulfates or bisulfates, either as anhydrous salts or as dihydrates. While these materials do not improve detergency, they function as bulking agents and often aid in absorbing liquids, near liquids or tacky ingredients so as to promote the flowability of the resulting product.

In addition to the fillers, the composition of the present invention may also include supplemental organic detergents which are compatible with the major synthetic organic detergent of the present composition. It is preferred to utilize anionic detergents since these are most compatible and of the anionics the preferred detergents are the higher alkyl benzene sulfonates, particularly the straight chain and 12–16 carbon atoms alkyl benzene sulfonates, higher alkyl alcohol sulfonates, higher olefin sulfonates, higher fatty acid soaps, additionally functioning as foam suppressants, and higher alkyl toluene sulfonates. The higher alkyl groups usually are within the range of from 10 to 18 and preferably within the range of from 12 to 16 carbon atoms. The nonionic detergents which may also be utilized as supplemental detergents include the polyethoxylated higher alcohols, the middle and high alkylphenol polyethylene ethanols, the block copolymers of ethylene oxide and propylene oxide, i.e. the pluronics, and the heteric polymers of ethylene oxide and propylene oxide either terminally etherified or hydroxylated. Also, amphoteric detergents such as imidazolines, pyrazolines, imides and Mannheimer ampohterics may be utilized. It is generally not preferred to utilize cationic detergents as supplemental detergents since these react with the anionics and diminish the detersive activities of both materials.

Also, various adjuvants may be present in the dry detergent composition of the present invention either to give additional desired properties of a functional or aesthetic nature. These may inclue soil-suspending and anti-redeposition agents such as polyvinyl alcohol, sodium carboxymethyl cellulose, hydroxypropyl methyl cellulose; optical brighteners, i.e. cotton, amide and polyester brighteners which will be discussed in more detail subsequently; various pH adjusting agents such as sodium hydroxide, triethanolamine, sulfuric acid; various buffering agents such as sodium borate, sodium bisulfate; various enzymes such as proteases, amylases; foam destroyers such as the silicones; bactericides such as tetrachlorosalicylanilide, hexachlorophene; fungicides; dyes; pigments; preservatives; ultraviolet absorbers; fabric softeners; and perfumes. The adjuvants should be selected so that they are compatible with the main constitutents of the detergent.

Of the adjuvants mentioned above, the most important class of adjuvants are the optical brighteners because the modern housewife has come to expect that washed clothing will no longer merely be clean and white but will also be bright in appearance. These optical brighteners are usually selective with regard to the textiles being washed and sometimes have comparatively low solubilities. Accordingly, it is important that upon contact with the wash water they become immediately dispersed so as to avoid producing a wash containing noticeably brightened spots rather than a uniformly bright appearance. The choice of brightener will depend upon the specific materials within the composition and may be chosen by one of ordinary skill in the art. It has been found that relatively small quantities of brighteners may be utilized and within the class of the optical brighteners certain brighteners have been found to be especially readily dissolved and are most suitable for incorporation in dry heavy duty detergent compositions. Fortunately, such preferred brighteners include both cotton and amide polyester brighteners making them suitable for use with laundries containing a variety of natural and synthetic materials.

Although one may utilize a single brightener in the compositions of the present invention, it is generally desirable to utilize a mixture of these so as to have good brightening effects on cotton, nylons, polyesters and blends of such materials and to maintain brightening activity even in the presence of chlorine bleaches. A good description of the various types of optical brighteners suitable for obtaining these results is given in the artilce, *Optical Brighteners and Their Evaluation*, by Per S. Stensby, a reprint of articles published in *Soap and Chemical Specialties* in April, May, July, August and September, 1967, especially pages 3–5 thereof.

The cotton brighteners are frequently referred to as CC/DAS brighteners and are derived from the reaction product of cyanuric chloride and the disodium salt of diaminostilbene disulfonic acid. The compounds generally differ with respect to substituents on triazine and aromatic rings. Bleach-stable brigtheners are usually benzidine sulfone disulfonic acids, a naphthotriazolyl stilbene sulfonic acid or a benzimidazolyl derivative. Polyamide brighteners are generally either aminocoumarin or diphenyl pyroazoline derivatives and polyester brighteners, which are also useful on polyamides, may be naphthotriazolylstilbenes. The brighteners are normally present as their soluble salts but may be added as the corresponding acids. The cotton brighteners usually comprise a major part of the brightener sytstem and are generally accompanied by a minor proportion of an amide-polyester brightener. Among the brighteners that are used in the present systems are: Calcofluor White ALF (American Cyanamid); ALF-N (American Cyanamid); SOF A-2001 (C1BA); CWD (Hilton-Davis); Phorwite RKH (Verona); CSL, powder, acid (American Cyanamid); CLS, liquid, monoethanolamine salt (American Cyanamid); FB 766 (Verona); Blancophor PD (GAF); UNPA (Geigy); Tinopal RBS (Geigy); and RBS 200 (Geigy).

Most of the automatic washing machines utilized in the home are top-loading types, having tub capacities of from 15 to 18 gallons. Due to the agitator construction of these machines, and the fact that the tubs are open at the top, foam produced in the washing rises and does not interfere with washing to the laundry, as might be the case in horizontal axis or front-loading washing machines. Such machines are usually of lesser water capacity, being from 7 to 9 gallons on the average, and the greater proportion of laundry to wash water usually allows the use of less detergent to effect the same degree of washing, providing that there is no foam-lock preventing good contact of detergent solution and laundry. Although the foam may help to float off particulate soil in a top-loading automatic washing machine and although housewives have in the past associated good foaming with good detergency, in recent years it has been considered desirable to limit the amount of foam produced by heavy duty washing products. Therefore, in heavy duty dry detergent compositions of the present invention, whether intended to use in top-loading or front-loading automatic washing machines, it is often desirable to include a compound to limit the amount of foam produced. Yet, of course, any additive to produce such a result should be compatible with the other components of the product and should not adversely influence washing action.

It has been found that foam can be regulated when desired so little or no foam is produced while a high level of detergency is maintained, by the addition of a water-soluble soap of higher fatty acid or mixture of such soaps to the present dry detergents. The higher fatty acid soaps employed are usually alkali metal salts, e.g., sodium and potassium salts, of mixed higher fatty acids, such as the mixtures of acids obtained from natural animal and vegetable fats and oils. Such soaps will generally comprise a major proportion of saturated fatty acid soaps of chain lengths from 10 to 18 carbon atoms. The most preferred mixtures are obtained by blending tallow and coconut oil fatty acids or by making soap from mixed tallow and coconut oil charges. For the purpose of this invention, such soaps will usually be more than 50% tallow and preferably will be from 80 to 100% tallow, with the balance usually being coconut oil or substitute oil therefor. Other solubilizing cations may be employed to make the desired soaps, such as ammonia, triethanolamine, trimethylamine, and other lower amines and alkanolamines, such as were previously described with respect to the synthetic detergent constituent.

As is well known, the higher fatty acid soaps, such as those presently employed as anti-foaming agents in these dry detergents, also possess good detersive actions and thereby, use of them to limit foaming does not interfere with detergency. With respect to certain soils for which the soaps are preferable detergents, such use actually improves detergency.

The pH of the heavy duty dry detergents in water may vary from 2 to 12 with the detergency being particularly outstanding within the range of from 7 to 9. Somewhat higher alkalinity may be dictated by the presence of various adjuvants which require pHs in excess of 7 to 9 such as various optical brighteners.

Although it is preferred to produce the novel heavy duty dry detergent of the present invention by spray-drying, the detergent also can be produced by mixing the above-noted dry ingredients together although when utilizing such method, the risk of segregation during shipping due to the varying densities of the materials is present. Furthermore, the dry detergent of the present invention may be formed into tablets or pellets by any conventional pressing operation.

The constituents of the present heavy duty detergents are important in order to maintain a product having good uniformity and good heavy duty laundry activity. The product should contain a significant proportion of the fatty alcohol-ethylene oxide sulfate and the builder. Generally, the anionic synthetic detergent forms from 8 to 30% of the total dry composition and preferably forms from 10 to 20% thereof, and most preferably about 15%. Such proportion in conjunction with the proportion of non-phosphate builder employed makes the desired product. For the greatest utility the quantity of supplementary detergents or surface active agents employed with the fatty alcohol-ethylene oxide sulfates should be limited to about 30% of the main detergent concentration and care should be taken to avoid the presence of such supplementary materials which are incompatible with other components in the heavy duty dry detergent composition of the present invention.

The various builders utilized may be present within a range of from about 10 to about 70% by weight. The preferred range of total amount of non-phosphate builder utilized is from 40 to 60% by weight and the preferred proportion is approximately 50% by weight total composition. Although any mixture of the above-noted non-phosphate builders may be utilized, sodium citrate dihydrate is the most preferred builder and is especially effective when utilized with the preferred anionic detergent of the present composition.

The heavy duty dry detergent of the present invention also may contain a small amount of moisture, i.e. within the range of from 3 to 15% by weight of the total composition. Generally, it is preferred to maintain the moisture at the lower end of this range so as to reduce any possibility of caking and lumping in the product.

The water-soluble soap utilized to reduce foaming and for supplemental washing powers is a minor component in the heavy duty dry detergent of the present invention and is generally from 0.5 to 5% thereof and preferably 1 to 2% thereof. The fluorescent brighteners system comprises from about 51 to 90% cotton brightener, the balance being one or more polyamide brighteners, polyester brighteners, and chlorine-stable brighteners, and the total fluorescent brightener content of the dry detergent will normally be from 0.2 to 2%, preferably from 0.4 to 1% and most preferably about 0.7%. This concentration is sufficiently soluble in the wash water to evenly disperse therein and is effective in noticeably brightening washed clothing.

The various other adjuvants noted above should not generally exceed 20% of the total composition, and preferably will be maintained at less than 15% and most preferably less than 10% of the phosphate-free heavy duty synthetic detergent of the present invention. The individual components should not exceed 10%, preferably 5% and most preferably will be less than 3% of the product.

The utilization of the heavy duty dry detergents of the present invention is as any ordinary household dry detergent will be utilized. Since the concentration of detergent in a wash water is generally within the range of from 1 to 2.5 g/l, and preferably 1.5 g/l, the weights of dry detergent charged into the various washing machines will be about 50 g for horizonal tub machine having a capacity of 7 to 9 gallons, and about 100 g for a top-loading washing machine having a capacity of from 15 to 18 gallons. Generally, these proportions will correspond to about 0.1 to about 0.3 g/l of the higher fatty alchol ethoxylate sulfate, from 0.1 to 1.0 g/l of the builders, from 0.01 to 0.1 g/l of soap as an anti-foaming agent, 0.01 to 0.02 g/l of optical brightener and from 0.01 to 0.1 g/l of other adjuvants.

The wash water utilized with the composition of the present invention may be relatively hard although it is preferred to utilize fairly soft water if available. Furthermore, it is generally preferred to utilize the heavy duty dry detergent of the present invention at elevated laundering temperature. The present composition is especially well adapted, however, for laundering clothes in very hard waters, i.e. those having water hardnesses of over 300 parts per million, calculated as calcium carbonate. Generally, the washing temperatures may be within the range of from 10° to 90° C.; however, preferable temperatures will be within the range of 20° to 70° C. Washing generally will be conducted in an automatic washing machine wherein the washing is followed by rinsing and spinning or other draining or wringing cycles or operations. The other washing conditions such as time which may be from 3 minutes to 1 hour depend upon the fabrics being washed, the type of washing machine utilized and the degree of soil observed. Subsequent to washing, spinning, draining and wringing it is preferred to dry this laundry in an automatic dryer although line-drying may be utilized. A fabric softener rinse may also be utilized washing and drying or at other suitable stages in the laundering process.

The composition of the present invention dissolves readily in wash water whether warm or cold and effectively cleans clothing and other items of laundry. It may be utilized in either top-loading or front-loading machines by adjusting the foam level to the correct extent. The product generally in its spray-dried form is a white, freely flowing, powder of pleasing texture and uniformity and maintains this texture and uniformity and activity over a long shelf life. In tests in which the effects of using the composition of the present invention are compared to those from conventional, commercial heavy duty laundering detergents, the composition of the present invention rated quite favorably, especially when considering that no special treatment is required for the composition of the present invention before being disposed into ordinary drains or sewers. Furthermore, it is often preferred because of the excellent detergency which is observed and for its non-polluting characteristics. Even if the washing results of the product of the present invention were not as good as those obtained with commercial polyphosphate products, its anti-pollution characteristic is significant enough to warrant the replacing of heavy duty phosphate built compositions with the instant composition. Therefore, since detergency resulting is on the same order as that obtained with phosphate-containing detergents and has the similar resistance to hard waters, the significance of the advance is that much greater.

The composition of the present invention will now be illustrated by way of the following illustrative examples which are for the purposes of illustration only and are in no way to be taken as limiting. All parts and percentages are by weight and all temperatures are in degrees centigrade unless otherwise noted in the following examples.

EXAMPLE 1

A white, free-flowing, spray-dried detergent having the following formula is evaluated in comparison with a commercially acceptable detergent utilizing New Brunswick, New Jersey, tap water containing about 100 parts per million magnesium and calcium hardness as expressed as calcium carbonate:

| | % |
|---|---|
| Neodol 25-3S | 15.00 AI |
| Soda Ash | 45.00 |
| Sodium Silicate (1 : 2.35) | 18.40 |
| Carboxy Methyl Cellulose (CMS) | 0.50 |
| Brighteners | 0.84 |
| $Na_2SO_4$ | 10.26 |
| Water | 10.00 |
| | 100.00 |

In one set of tests, cotton cloths are repeatedly soiled by rubbing these cloths against human skin at various periods during the day followed by evenly dividing these cloths and washing utilizing the above-noted dry detergent and the control product in a laboratory Terg-o-tometer washing machine. Reflectometer readings are taken on the washed cloths and are compared to determine the extent of soil removal which is utilized to perform a statistical analysis to establish whether or not a difference exists between the washing abilities of the materials tested.

The statistical analysis shows that the instant heavy duty dry detergent containing no phosphates performs as satisfactorily as the control product which contains approximately 35% of polyphosphates. Following repeated resoiling and rewashing of the same materials, the same results are obtained. When the above-noted dry heavy duty detergent is tested against a commercial product utilizing a bundle test having a variety of soiled articles of clothing made of cotton, polyester-cotton blends, rayon and nylon utilizing a full size automatic washing machine, the small scale Terg-o-tometer test results are confirmed.

Similar results are obtained when the Neodol 25-3S is replaced by the higher fatty alcohol ethoxylate sulfates including those wherein the higher fatty alkyl is mixed $C_{12-13}$ or $C_{14-15}$; however, it appears that the mixture of $C_{12-15}$ is a better washing agent in the present composition than the narrower cuts of higher fatty alcohol derivatives. With respect to ethoxylation, comparable results are obtained when the higher fatty alcohol is ethoxylated from 2 to 4 times, providing that the hydrophilic-lipophilic balance is maintained about the same as that for the Neodol 25-3S. Thus, when the higher carbon content alkyls of the higher alkyl group are utilized, the degree of ethoxylation should be higher, i.e. 4 to 5, whereas at the lower carbon content the degree of ethoxylation should be from 2 to 4. Good detergency is also obtained when, in any of the fatty alkyl ethoxylate sulfates described, the cation is potassium, ammonium, lower alkylamine or lower alkanolamine.

Instead of the mixture of soda ash and sodium silicate utilized as builders, sodium citrate dihydrate and other forms of citric acid intermediate salts may be utilized, including the potassium, ammonium and lower alkylamine salts of these materials.

Approximately 100 g of dry detergent are utilized for the top-loading washing machines in the tests described above; however, this amount may be reduced in half for front-loading horizontal drum machines. In actual use on soiled clothing, the concentration of the dry material subsequent to the addition of water to the tub should be from 1 to 2.5 g/l depending upon the heaviness of soil on the laundry. Usually from 1 to 2 g/l will be sufficient to clean an average wash. The washing temperature used in the above is about 65° C. Also under such conditions the pH of the wash water will normally be about from 7 to 9 and in most of the above-noted tests it is about 8.5 at the beginning of washing and is diminished about 1 pH unit as washing proceeds. Of course, after completion of washing the clothing is rinsed with water and sometimes using as many as three rinses after which the water is removed by spin drying, vacuum techniques or by wringing and the laundry is dried, preferably in an automatic dryer although line drying may also be effectively utilized.

EXAMPLE 2

Example 1 is repeated except the amount of sodium sulfate is increased to 35% while the total amount of builder is reduced to 45% and comprises sodium citrate dihydrate. The detergency is approximately equivalent to that in Example 1 and the hard water resistance is somewhat increased.

EXAMPLE 3

The following compositions are prepared utilizing 15% of the anionic detergent, 50% builder and 35% sodium sulfate:

TABLE I

| Builder | Δ Rd (Units Soil Removed) NB Tap (100 ppm) Neodol 25-3S* | NB Tap (100 ppm) LTBS | 300 ppm Neodol 25-3S* | 300 ppm LTBS |
|---|---|---|---|---|
| (1) Soda Ash ($Na_2CO_3$) | 21.1 | 21.3 | 17.0 | 14.2 |
| (2) Sodium Silicate (1 : 2.35) | 20.8 | 21.3 | 18.7 | 7.5 |
| (3) 1 : 1 Blend of (1) and (2) | 21.1 | 22.3 | 17.9 | 12.5 |
| (4) Sodium Citrate Dihydrate | 22.8 | 18.5 | 22.2 | 9.4 |

*$C_{12-15}$ primary alcohol-3moles ethylene oxide sulfate, sodium salt; 60% AI, 14% ethanol, 26% $H_2O$; Shell Chem. Co.

The above-noted compositions was utilized in New Brunswick tap water of 100 parts per million and also in water containing hardness level of 300 parts per million at a 0.05% product concentration with the washing being conducted at 49° C. The materials washed in each of these compositions are tested utilizing the Spangler soil detergency test wherein the results of this test of a one Rd unit difference are visually significant. The LTBS utilized is linear tridecyl benzene sulfate and the Neodol 25-3S is $C_{12-15}$ primary alcohol reacted with 3 moles of ethylene oxide sulfate, sodium salt.

As noted from Table I the composition of the present invention utilizing the higher fatty alcohol-ethoxylate sulfates has improved hard water resistance when compared with the linear tridecyl benzene sulfate anionic detergents. Furthermore, the sodium citrate dihydrate is an especially effective builder yet higher water hardness levels are to be encountered.

EXAMPLE 4

Example 1 is repeated varying the concentration of the ethoxamer as follows with a corresponding change in the builder concentration:

A. 8% ethoxylated sulfate of Example 1
B. 15% ethoxylated sulfate of Example 1
C. 50% ethoxylated sulfate of Example 1
D. 20% sodium n-decyl diethenoxy sulfate
E. 25% ammonium lauryl diethenoxy sulfate
F. 15% diethanolamine salt of stearyl pentaethenony sulfate
G. 22% potassium myristyl trietheneoxy sulfate Excellent results are achieved in each case.

EXAMPLE 5

Examples 4A through 4G are each separately varied as to the builder utilized as follows with a corresponding addition or substraction of filler material:

A. 55% sodium citrate .$2H_2O$
B. 45% sodium citrate, anhydrous
C. 20% citric acid
D. 40% potassium citrate, anhydrous
E. 25% ammonium citrate
F. 35% diethanolammonium citrate
G. 25% trimethylammonium citrate
H. 45% soda ash
I. 55% sodium silicate (1:1.7)
J. 45% mixture of 50% soda ash and 50% sodium silicate (1:1.7)

Excellent results are achieved in each case.

While the composition of the present invention has been illustrated by way of the foregoing specific examples, such examples are for the purpose of illustration only and the composition of the present invention is to be limited only by way of the following appended claims and any and all equivalents thereto.

What is claimed is:

1. A heavy duty dry detergent composition devoid of phosphate and nitrogeneous builders and which consists essentially of about 8 to about 30% of water-soluble anionic synthetic detergent salt of the formula $RO(C_2H_4O)_nSO_3M$, wherein R is a substantially straight chain fatty alkyl of from 10 to 20 carbon atoms, *n* is a number from 2 to 6, *n* being from about one-fifth to one-third the number of carbon atoms in R, and M is a salt-forming cation; about 30 to 70% by weight of a water-soluble builder salt selected from the group consisting of silicates, carbonates, oxydiacetates citrates and mixtures thereof; about 0 to 5% of an alkali metal soap; and about 10 to 50% by weight of a filler selected from the group consisting of sodium chloride, sodium sulfate and sodium bisulfate.

2. The heavy duty dry detergent composition of claim 1 wherein M is selected from the group consisting of alkali metal, ammonium, lower alkylamino and lower alkanolamino, and wherein the builder salt is a citrate.

3. The heavy duty dry detergent composition of claim 2 which contains from 10 to 20% of water-soluble anionic synthetic detergent salt of the formula $RO(C_2H_4O)_nSO_3M$, wherein R is a straight chain alkyl of from 12 to 15 carbon atoms, *n* is from 2 to 4, and M is an alkali metal.

4. The heavy duty dry detergent composition of claim 3 wherein R is a mixture of straight chain alkyls of from 12 to 15 carbon atoms terminally joined through the oxygen to the polyethoxy chain, *n* is about 3, and M is sodium.

5. The heavy duty dry detergent composition of claim 3 further containing from 0.4 to 1% of an optical brightener system comprising a major proportion of cotton brightener and a minor proportion of polyesteramide brightener.

6. The heavy duty dry detergent composition of claim 4 wherein said mixed alkyl contains at least 10% of each chain length and no more than 50% of any one chain length.

7. The heavy duty dry detergent composition of claim 2 wherein said citrate is sodium citrate dihydrate.

8. The heavy duty dry detergent composition of claim 2 further containing from 0.5 to 5% of a water-soluble alkali metal soap, said composition being essentially non-foaming and leaving no more than a trace of foam in rinse water employed to rinse out detergent and dirt from washed laundry.

9. The heavy duty dry detergent composition of claim 1 wherein said builder is sodium or potassium silicate having an $Na_2O:SiO_2$ or $K_2O:SiO_2$ ratio of from 1:1.5 to 1:2.5.

10. The heavy duty dry detergent composition of claim 1 further containing up to 30% of said anionic detergent of a $C_{10}$–$C_{18}$ alkyl benzene sulfonate.

11. The heavy duty dry detergent composition of claim 1 having a pH in water of from 7 to 9.

12. The heavy duty dry detergent composition of claim 1 wherein said builder is a mixture of soda ash and sodium silicate having an $Na_2O:SiO_2$ ratio of 1:2.35.

13. The heavy duty dry detergent composition of claim 1 further containing from 0.2 to 2% of fluorescent brightener.

14. The heavy duty dry detergent composition of claim 13 wherein said brightener comprises from about 51 to 90% cotton brightener, the balance being one or more of polyamide, polyester brightener.

15. The heavy duty composition of claim 13 wherein said brightener is an amino coumarin or diphenyl pyrazoline derivative.

16. The heavy duty detergent composition of claim 13 wherein said brightener is the reaction product of cyanuric chloride and the disodium salt of diaminostilbene disulfonic acid.

17. The heavy duty detergent composition of claim 13 wherein said brightener is a benzidene sulfone disulfonic acid, a napthotriazolyl stilbene sulfonic acid or a benzimadazolyl derivative.

18. The heavy duty dry detergent composition of claim 14 wherein said brighteners are chlorine stable.

19. A process for laundering textiles which comprises contacting said textiles with the composition of claim 1 at a temperature of from 10° to 90° C, the concentration of said detergent being from 1 to 2.5 g/l of wash solution.

* * * * *